US009184037B2

(12) United States Patent
Kumano et al.

(10) Patent No.: US 9,184,037 B2
(45) Date of Patent: Nov. 10, 2015

(54) MASS SPECTROMETER AND MASS ANALYZING METHOD

(75) Inventors: Shun Kumano, Kokubunji (JP); Masuyuki Sugiyama, Hino (JP); Yuichiro Hashimoto, Tachikawa (JP); Hideki Hasegawa, Tachikawa (JP); Masuyoshi Yamada, Ichikawa (JP); Hidetoshi Morokuma, Hitachinaka (JP); Shuhei Hashiba, Wako (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 13/527,627

(22) Filed: Jun. 20, 2012

(65) Prior Publication Data

US 2012/0326022 A1 Dec. 27, 2012

(30) Foreign Application Priority Data

Jun. 27, 2011 (JP) ..... 2011-141388

(51) Int. Cl.
*H01J 49/00* (2006.01)
*H01J 49/04* (2006.01)

(52) U.S. Cl.
CPC ..... *H01J 49/0409* (2013.01); *H01J 49/0495* (2013.01)

(58) Field of Classification Search
CPC ..... H01J 27/02; H01J 27/04; H01J 27/08; H01J 27/14; H01J 27/143; H01J 27/146; H01J 27/20; H01J 27/205
USPC ..... 250/281, 282, 288, 289
See application file for complete search history.

(56) References Cited

U.S. PATENT DOCUMENTS

| | | | | |
|---|---|---|---|---|
| 3,649,862 | A * | 3/1972 | Wahlin | 313/361.1 |
| 4,239,967 | A * | 12/1980 | Carr et al. | 250/281 |
| 5,086,226 | A * | 2/1992 | Marcus | 250/288 |
| 5,705,787 | A * | 1/1998 | Karanassios | 219/121.52 |
| 6,278,111 | B1 * | 8/2001 | Sheehan et al. | 250/288 |
| 2003/0111600 | A1 * | 6/2003 | Thomson et al. | 250/288 |

(Continued)

FOREIGN PATENT DOCUMENTS

| | | |
|---|---|---|
| JP | 52-020088 | 2/1977 |
| JP | 64-027156 | 1/1989 |

(Continued)

OTHER PUBLICATIONS

Charles N. McEwen, et al., Analysis of Solids, Liquids, and biological Tissues Using Solids Probe Introduction at Atmospheric Pressure on Commercial LC/MS Instruments, Analytical Chemistry, Dec. 1, 2005, pp. 7826-7830, vol. 77, No. 23.

*Primary Examiner* — Nicole Ippolito
*Assistant Examiner* — Jason McCormack
(74) *Attorney, Agent, or Firm* — Baker Botts L.L.P.

(57) ABSTRACT

A mass spectrometer including a sample attaching member of attaching a sample, an ionizing chamber including an introductory port of the sample attaching member and an ionization source of generating a sample ion, a vacuumed chamber having a mass analyzer of analyzing the sample ion, and an opening/closing mechanism provided between the ionizing chamber and the vacuumed chamber, in which the opening/closing mechanism is controlled from a closed state to an open state after introducing the sample attaching member into the ionizing chamber to thereby enable to perform ionization with inconsiderable fragmentation at a high sensitivity with a high throughput.

19 Claims, 10 Drawing Sheets

(56) References Cited

U.S. PATENT DOCUMENTS

| | | | | |
|---|---|---|---|---|
| 2005/0057167 | A1* | 3/2005 | Siegfried et al. | 315/111.81 |
| 2007/0278401 | A1* | 12/2007 | Finlay | 250/289 |
| 2009/0272894 | A1* | 11/2009 | Shiokawa et al. | 250/282 |
| 2010/0243884 | A1* | 9/2010 | Shiokawa et al. | 250/282 |
| 2011/0031392 | A1* | 2/2011 | McEwen et al. | 250/283 |
| 2011/0108726 | A1* | 5/2011 | Hiraoka et al. | 250/282 |
| 2011/0168881 | A1* | 7/2011 | Sturgeon et al. | 250/282 |
| 2011/0240839 | A1* | 10/2011 | Hutchinson et al. | 250/282 |
| 2011/0253884 | A1* | 10/2011 | Ottleben et al. | 250/221 |
| 2011/0253889 | A1* | 10/2011 | Ishimaru et al. | 250/282 |
| 2012/0286151 | A1* | 11/2012 | Jarrell et al. | 250/282 |

FOREIGN PATENT DOCUMENTS

| | | | |
|---|---|---|---|
| JP | 09-210965 | | 8/1997 |
| JP | 09-223479 | | 8/1997 |
| JP | 10-69876 | | 3/1998 |
| JP | 2009-539115 | | 11/2009 |
| JP | 2010-002306 | | 1/2010 |
| JP | 2010-507787 | | 3/2010 |
| JP | 2010-085222 | | 4/2010 |
| JP | 2010-177057 | | 8/2010 |
| WO | WO 2007/140351 | A2 | 12/2007 |
| WO | WO 2008/049488 | A1 | 5/2008 |
| WO | WO 2009/031179 | | 3/2009 |

* cited by examiner

MASS SPECTROMETER AND MASS ANALYZING METHOD

CLAIM OF PRIORITY

The present application claims priority from Japanese patent application JP 2011-141388 filed on Jun. 27, 2011, the content of which is hereby incorporated by reference into this application.

FIELD OF THE INVENTION

The present invention relates to a mass spectrometer and a method of operating the same.

BACKGROUND OF THE INVENTION

In a mass spectrometer, there are a number of methods of transporting liquid and solid samples to an ionization source. Above all, an explanation will be given as follows of sample introduction using a probe of introducing a sample directly to an ionization source or a vicinity thereof.

US 2010/0243884 A1 describes a method of introducing a probe holding a sample to a sample vaporizing chamber at a vicinity of an ionization source under a reduced pressure. According to the method, a sample is vaporized by heating the probe, and a sample gas is introduced to the ionization source by making a gas flow from the sample vaporizing chamber in a direction to the ionization source. The sample gas is ionized at the ionization source by an ion-attachment ionization or the like, and generated ions are introduced into a mass analyzer by an electric field.

Japanese Unexamined Patent Application Publication No. Hei10 (1998)-69876 describes a small heating sample probe for directly introducing a sample to an ionization source for electron ionization (EI). The probe has a metal wire at a tip end thereof, sampling is carried out by adsorbing the sample to the wire, and the sample is heated to vaporize by applying a voltage on the wire. After introducing the probe into a vacuumed chamber ($10^{-3}$ through $10^{-4}$ Pa), a sample gas can be ionized by EI.

Analytical Chemistry, 2005, 77, 7826-7831 describes an atmospheric pressure solids analysis probe for introducing a sample directly to an ionization source for an atmospheric pressure chemical ionization (APCI). A sample is coated onto a tip end of a melting point capillary made of borosilicate and is inserted into a space where APCI is performed. The sample is gasified by blowing a high temperature gas to a sample coating portion, and a sample gas is ionized by a plasma generated by corona discharge. Generated ions pass through an orifice and are conveyed to a mass analyzer.

SUMMARY OF THE INVENTION

According to a configuration described in US 2010/0243884 A1, a preparatory exhaust chamber is needed between the sample vaporizing chamber and the atmosphere for introducing the probe from a side of the atmosphere to the sample vaporizing chamber, a structure thereof becomes complicated, and therefore, the configuration is disadvantageous for downsizing. Moreover, an ion loss in a transfer line is brought about when the sample gas moves from the sample vaporizing chamber the ionization source, which gives rise to a deterioration in a sensitivity.

In the EI ionization source described in Japanese Unexamined Patent Application Publication No. Hei10 (1998)-69876, the sample is ionized by impacting high energy electrons to the sample under high vacuum (about $10^{-4}$ Pa). Therefore, fragmentation of the sample by the impact is conspicuous. The fragmentation complicates a mass spectrum obtained and makes an analysis difficult. In a case of a highly volatile sample, the sample is vaporized at a time point of introducing the probe into vacuum, and the measurement cannot be performed.

The probe described in Analytical Chemistry, 2005, 77, 7826-7831 is a probe used in APCI. Generated ions are conveyed from under the atmospheric pressure to the mass analyzer which is a high vacuum area by passing through a small orifice or a capillary having a small conductance. Therefore, ions are lost in passing through the orifice or the capillary to bring about a deterioration in a sensitivity. Moreover, the sample is vaporized by blowing the heated gas to the probe, and therefore, the sample gas is diffused. There is a possibility that only a portion of the sample gas is ionized. A gas flow does not flow to the mass analyzer. Therefore, there is a possibility that only a portion of generated ions are taken into the mass analyzer. Therefore, it seems that an amount of ions subjected to mass analysis is small as opposed to an amount of the sample.

As described above, the deterioration in the sensitivity is brought about by diffusion of the gas in a procedure of vaporizing and ionizing the sample, or an ion loss by hitting ions on the surface of a transfer line in a procedure of introducing the ions to the mass analyzer. There poses a problem that mass spectra become complicated by the fragmentation of the sample. There also poses a problem by a deterioration in a throughput owing to a complication in interchanging the sample.

According to an example of a mass spectrometer for resolving the problem described above, there is provided a mass spectrometer including a sample attaching member of attaching a sample, an ionizing chamber including an introductory port of the sample attaching member and an ionization source of generating a sample ion of the sample, a vacuumed chamber including a mass analyzer of analyzing the sample ion, and an opening/closing mechanism provided between the ionizing chamber and the vacuumed chamber, in which the opening/closing mechanism is controlled from a closed state to an open state after introducing the sample attaching member into the ionizing chamber.

As an example of a mass analyzing method, there is provided a mass analyzing method which is a mass analyzing method using an ionizing chamber including an introductory port of a sample attaching member of attaching a sample and an ionization source, a vacuumed chamber including an introductory port of an ion of the sample and a mass analyzer, and an opening/closing mechanism provided between the ionizing chamber and the vacuumed chamber, the mass analyzing method including a step of reducing a pressure of the vacuumed chamber to be equal to or lower than 0.1 Pa in a state of closing the opening/closing mechanism, a step of introducing the sample attaching member arranged with the sample to the ionizing chamber, a step of making a pressure of the ionizing chamber equal to or higher than 100 Pa and equal to or lower than 5000 Pa by bringing the opening/closing mechanism to an open state after introducing the sample attaching member, a step of generating the sample ion of the sample arranged at the sample attaching member by driving the ionization source, and a step of analyzing a mass of the sample ion introduced from the ionizing chamber to the vacuumed chamber by the mass analyzer.

According to the present invention, ionization with inconsiderable fragmentation can be carried out at a high sensitivity with a high throughput.

DETAILED DESCRIPTION OF THE PREFERRED EMBODIMENTS

First Embodiment

Figure 1:
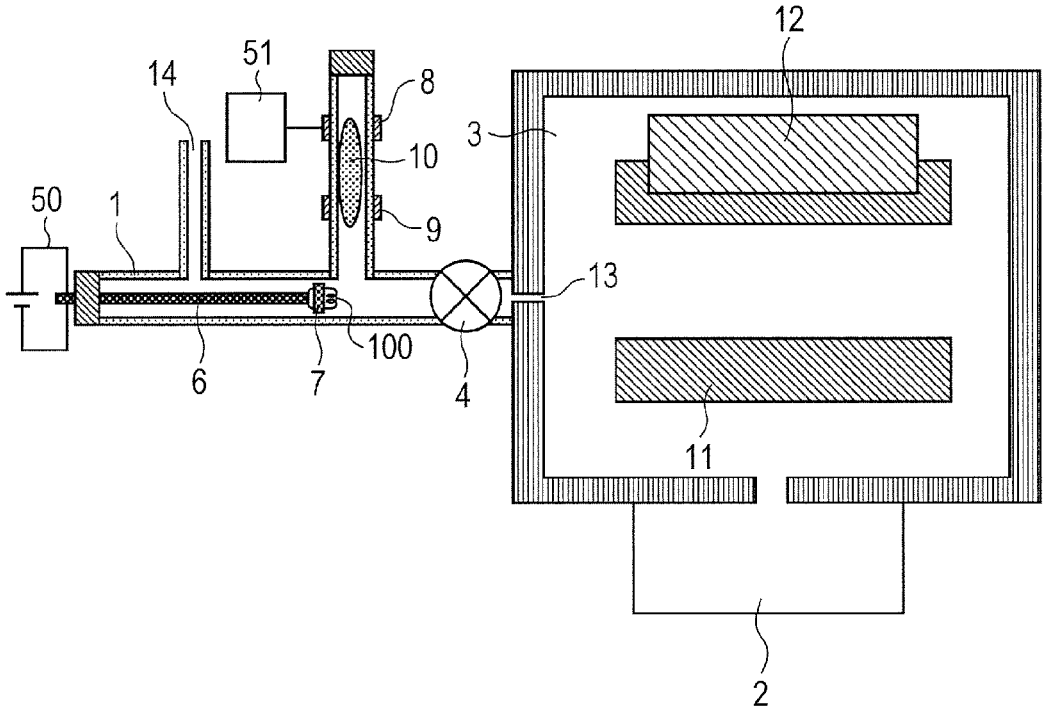
FIG. 1 is a configuration view of a mass spectrometer according to a first embodiment.

FIG. 1 is a configuration view showing an embodiment of a mass spectrometer according to the present invention. The mass spectrometer is mainly configured by an ionization source 1 made of a dielectric substance of glass, plastic, ceramic, resin etc. and a vacuum chamber 3 a pressure of which is maintained to be equal to or lower than $10^{-1}$ Pa by a vacuum pump 2. The ionization source 1 and the vacuumed chamber 3 are partitioned by a valve 4. The ionization source 1 is typically a pipe having an outer diameter of about 4 mm and an inner diameter of about 1 through 4 mm.

A sample introduction probe 6, having a resistance heating filament 100 at a tip end thereof, and to which the current can be made to flow from outside, is inserted into the ionization source 1. Here is exemplified a mode of inserting the sample introduction probe 6 having a handle to the cylindrical ionization source 1. The tip end of the sample introduction probe 6 is attached with the resistance heating filament 100. There is a cap for closing the ionization source 1 in a state of inserting the sample introduction probe 6 to the ionization source 1. Molybdenum, tungsten, tantalum, etc. can be used for the resistance heating filament 100. The resistance heating filament 100 is attached with a sample 7. Before inserting the sample introduction probe 6 to the ionization source 1, the resistance heating filament 100 is directly coated with a sample. Or, the resistance heating filament 100 is adhered with an adsorbent (filter paper, PDMS, other porous material etc.) that is adsorbed with the sample. The sample 7 is heated by heating the resistance heating filament 100 by supplying an electric power of about 1 through 20 W from a heating power source 50, and the sample 7 is gasified at inside of the ionization source 1. As the sample, a sample of a solid of a powder or the like, a liquid, or a gas can be adsorbed. The larger the power applied on the resistance heating filament 100, the higher the temperature of the resistance heating filament 1, and the more easily the sample 7 is gasified. On the other hand, when a necessary power is small, the mass spectrometer can be driven by a battery and the mass spectrometer can be carried.

A first discharge electrode 8 and a second discharge electrode 9 are arranged at a pipe that is provided by being connected to the ionization source 1 to be, for example, orthogonal to the sample introduction probe 6. Dielectric barrier discharge is generated by applying a voltage therebetween, and a discharge produced plasma 10 is generated. Charged particles are generated by a discharge produced plasma 10, water cluster ions are generated on the basis of the charged particles, and the sample 7 is ionized by ion-molecule interaction of the water cluster ions and the sample gas. The method is soft ionization using the discharge produced plasma, and an amount of fragmentation of sample ions is small in comparison with an EI ion source having a large amount of fragmentation as shown in Japanese Unexamined Patent Application Publication No. Hei10 (1998)-69876. In a case of intending to bring about fragmentation, a power applied on the discharge electrode may be increased as described below. The sample ions generated by the discharge produced plasma 10 are introduced to the vacuumed chamber 3 by passing through an orifice 13 by opening the valve 4. A mass analyzer 11 and a detector 12 are installed in the vacuumed chamber 3. The introduced ions are isolated for respective m/z by the mass analyzer 11 of a quadrupole mass filter, an ion trap, a time-of-flight mass spectrometer, etc., and detected by the detector 12 of an electron multiplier, etc.

Figure 2A:
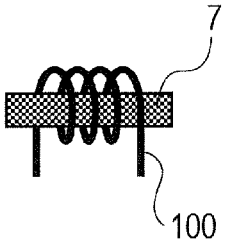
FIGS. 2A, 2B, and 2C illustrate examples of shapes of resistance heating filaments.
Figure 2B:
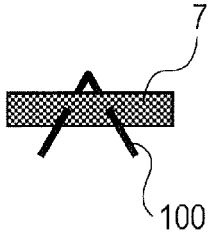
Figure 2C:
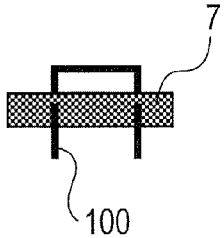

There is no restriction in the shape of the resistance heating filament 100 at the tip end of the sample probe, and various shaped are conceivable as shown in FIGS. 2A, 2B, and 2C. The surface of the resistance heating filament 100 may be coated so as to make the resistance heating filament 100 easy to adsorb the sample. An adsorbent may be fixed to the resistance heating filament 100 by any method. The adsorbent may be wound around by the resistance heating filament 100 as shown in FIG. 2A. Or, the adsorbent may be pierced with the resistance heating filament 100 as shown in FIGS. 2A, and 2C.

The sample introduction probe 6 may be inserted to any place in the ionization source that generates the discharge produced plasma 10. However, a conductance in the ionization source is large to a degree by which a pressure in the ionization source at any space substantially stays the same. Substantially the same mentioned here signifies that a difference in the pressure in the ionization source is to a degree of doubling the pressure. For example, in FIG. 1, the tip end of the sample introduction probe 6 attached with the sample 7 may be arranged just below the discharge produced plasma 10, or on a valve side of the discharge produced plasma 10. A distance between the discharge produced plasma 10 and the tip end of the sample probe 6 is typically about 5 mm. The nearer the area of ionizing the sample 7 by the discharge produced plasma 10 to the vacuumed chamber, the more the probability of impacting ions to a transfer line to vanish can be reduced. When the sample is vaporized by inserting the probe holding the sample not to the ionization source but to the sample vaporizing chamber contiguous to the ionization source as shown in US 2010/0243884 A1, loss of the sample is brought about by adsorbing the sample gas to the transfer line or diffusing the sample gas until being transported to the ionization source. The sample is carried over by adsorbing the sample gas to the transfer line. On the other hand, in a structure proposed by the present invention, the sample introduction probe 6 is inserted into the ionization source 1, and the sample is gasified and ionized at the same location. The sample is vaporized and promptly ionized with no time of being adsorbed to the transfer line. Therefore, an amount of loss of the sample or carry-over of the sample to successive measurement is small. The structure is simple and suitable for downsizing.

When the sample introduction probe 6 is inserted to the ionization source 1 and the sample 7 is ionized, the valve 4 is brought into an open state. The vacuumed chamber 3 is maintained at a pressure equal to or lower than 0.1 Pa. The pressure of the ionization source 1 is determined by an exhaust rate of the pump 2, a conductance of the orifice 13, and a conductance of a gas introducing slender pipe 14 provided to be connected to the ionization source on a side opposed to the vacuumed chamber 3 relative to the sample 7. The nearer the pressure of the ionization source 1 to the pressure of the vacuumed chamber 3, the more the loss in introducing ions from the ionization source 1 to the vacuumed chamber 3 is reduced. Therefore, a sensitivity of the mass spectrometer is increased when the ionization is performed under a reduced pressure more than when the ionization is performed under the atmospheric pressure. On the other hand, there is present a pressure range of generating the discharge produced plasma 10 stably, and a typical value thereof falls in a range of 100 through 5000 Pa. Also, a pressure range in which the ionization can be performed efficiently falls in a range of 500 through 3000 Pa. When the pressure is below 500 Pa, fragmentation of ions is intensified. Also, the plasma is not generated at the pressure equal to or lower than 1 Pa. An ionization source of an EI ionization source as shown in Japanese Unexamined Patent Application Publication No. Hei10 (1998)-69876 is maintained at a pressure of about $10^{-4}$ Pa. Therefore, when the sample is introduced into the ionization source, the sample is volatilized. According to the present method, the ionization source 1 is maintained at the pressure equal to or higher than 100 Pa in order to stably generate the discharge produced plasma 10, and the sample is difficult to be evaporated.

A pressure at outside of the ionization source 1 is higher than that of the ionization source 1 or is the atmospheric pressure. A gas flow is produced from the gas introducing slender pipe 14 to the vacuumed chamber 3 by a difference between the pressure at inside of the ionization source 1 and the vacuumed chamber 3 and the pressure at outside of the ionization source 1. The sample ions are efficiently transported into the vacuumed chamber 3 by the gas flow. Adsorption of the sample to an inner wall of the ionization source 1 is reduced owing to the presence of the gas flow. Not only a deterioration in a sensitivity by loss of the sample but also carry-over of the sample to successive measurement can be prevented by reducing the adsorption.

As the valve 4, for example, a pinch valve, a slider valve, a ball valve etc. is used. The gas introducing slender pipe 14 may be an orifice when the orifice is operated as a necessary conductance. When outside of the ionization source 1 is the atmosphere, air is made to flow in from the gas introducing slender pipe 14 into the ionization source. On the other hand, a specific gas of a rare gas etc. of He or the like may be introduced from the gas introducing slender pipe 14. In Analytical Chemistry, 2005, 77, 7826-7831, only the high temperature gas is blown to the probe holding the sample, and diffusion of the generated sample gas is not controlled. On the other hand, according to the present method, there is generated the gas flow directed to the mass analyzer in the ionization source. The sample gas is not considerably diffused but is introduced efficiently into the vacuumed chamber 3 after having been ionized by the discharge produced plasma 10. Also ions are borne on the flow of the gas under a pressure region equal to or higher than 100 Pa. In US 2010/0243884 A1, generated ions are conveyed to the mass analyzer by an electric field. The direction of the electric field is a direction orthogonal to the gas flow by which the sample gas is transported. There also exist ions which progress not along the electric field but a gas flow and the sensitivity is lowered. According to the structure proposed by the present invention, in comparison with the structure of Analytical Chemistry, 2005, 77, 7826-7831, the gas flow transports ions to the vacuumed chamber 3 where the mass analyzer is present, and therefore, generated ions can be introduced wastelessly.

Figure 3:
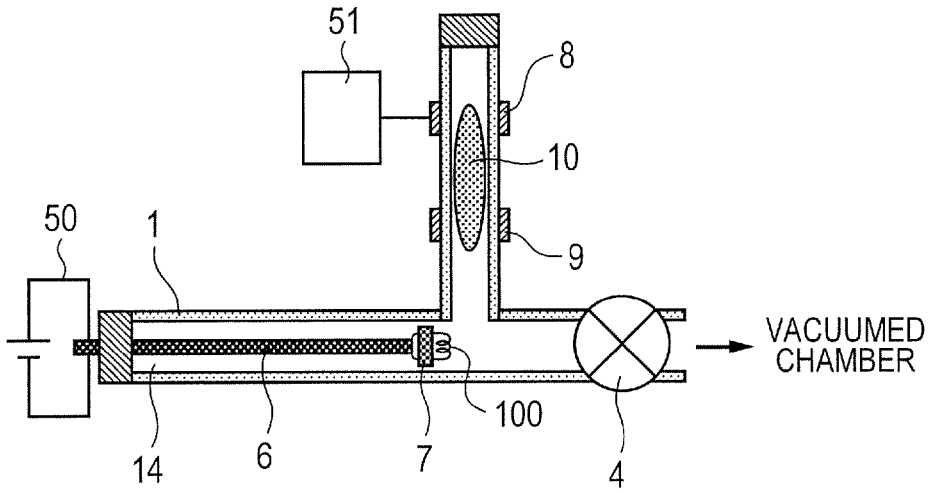
FIG. 3 illustrates Example 1 of an ionization source of the first embodiment.
Figure 4:
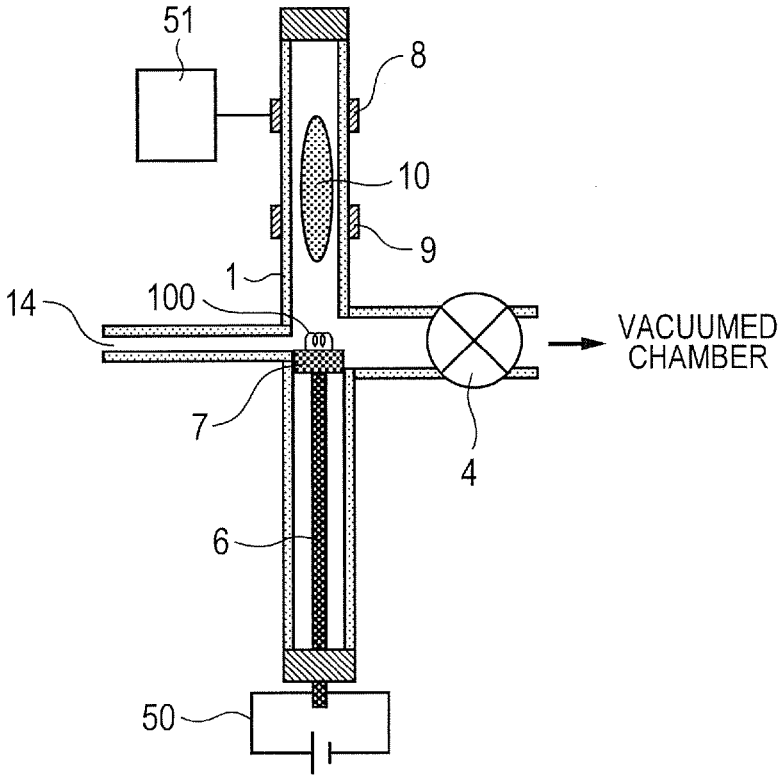
FIG. 4 illustrates Example 2 of the ionization source of the first embodiment.

As a positional relationship among the sample introduction probe 6, the discharge produced plasma 10, and the gas introducing slender pipe 14, various patterns are conceivable so far as the positional relationship is a relationship by which the gas introduced from outside can transport the gas sample efficiently to the vacuumed chamber 3. Examples thereof are shown in FIG. 3 and FIG. 4. As shown in FIG. 3, the gas introducing slender pipe 14 may be arranged at a port of the ionization source for introducing the sample introduction probe 6 in a direction the same as an axial direction of the sample introduction probe 6 by opening a slender pipe at a cap or the like. Or, as shown in FIG. 4, the direction of the gas introducing slender pipe 14 may be arranged to be directed to the vacuumed chamber, and the ionization source 1 having the sample introduction probe 6 and the portion of generating the discharge produced plasma 10 may be provided to be orthogonal to the gas introducing slender pipe 14.

A distance between the first discharge electrode 8 and the second discharge electrode 9 is typically about 5 mm. The longer the distance between the discharge electrodes, the higher the power necessary for discharge. For example, an alternating current voltage is applied on one of the discharge electrodes from a power source 51, and a DC voltage is applied to the other discharge electrode. The applied alternating current voltage may be of a rectangular wave or a sine wave. As a typical example, the applied voltage falls in a range of 0.5 through 10 kV and its frequency falls in a range of about 1 through 100 kHz. A density of the discharge produced plasma 10 is increased by using the rectangular wave when a voltage amplitude stays the same. On the other hand, in the sine wave, in a case of a high frequency, the voltage can be stepped up by a coil. Therefore, the sine wave achieves an advantage that the power source 51 is more inexpensive than in a case of using the rectangular wave. The higher the voltage and the frequency, the higher the inputted power, and therefore, the higher the density of the discharge produced plasma 10. However, when the inputted power is excessively high, a temperature of the plasma becomes high and fragmentation is liable to be brought about. The frequency or the voltage of the alternating current voltage may be changed for each sample or ion that is an object of measurement. For example, the inputted power is increased in a case of measuring a molecule which is difficult to be subjected to fragmentation as in an inorganic ion or in a case of intending to subject an object ion to fragmentation and measuring a fragment ion, and the inputted power is reduced in a case of measuring a molecule which is easy to be subjected to fragmentation. Power consumption of the power source 51 can be reduced when switching is carried out so as to apply the voltage on the discharge electrode only when needed.

Figure 5A:
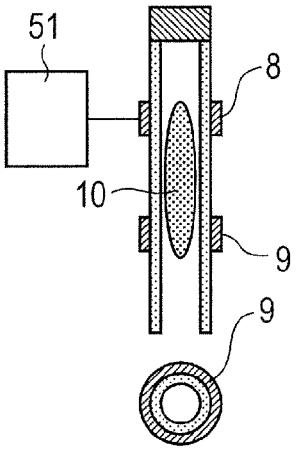
FIGS. 5A, 5B and 5C illustrate configurations of discharge electrodes of the first embodiment.
Figure 5B:
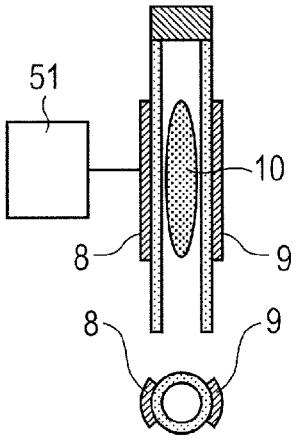
Figure 5C:
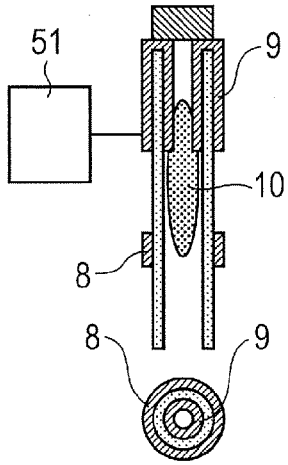

The arrangement of the discharge electrodes can variously be changed so far as discharge is performed via a dielectric substance. FIGS. 5A, 5B, and 5C show views viewing cylinders from a horizontal direction and sectional views. FIG. 5A shows an arrangement of the discharge electrodes shown in FIG. 1 and two of the cylindrical electrodes are used. An electrode in a plane shape as shown in FIG. 5B may be used. As shown in FIG. 5C, one of electrodes may be inserted into a dielectric substance. Also a number of electrodes is not limited to two but may be increased to 3 or 4.

Figure 6:
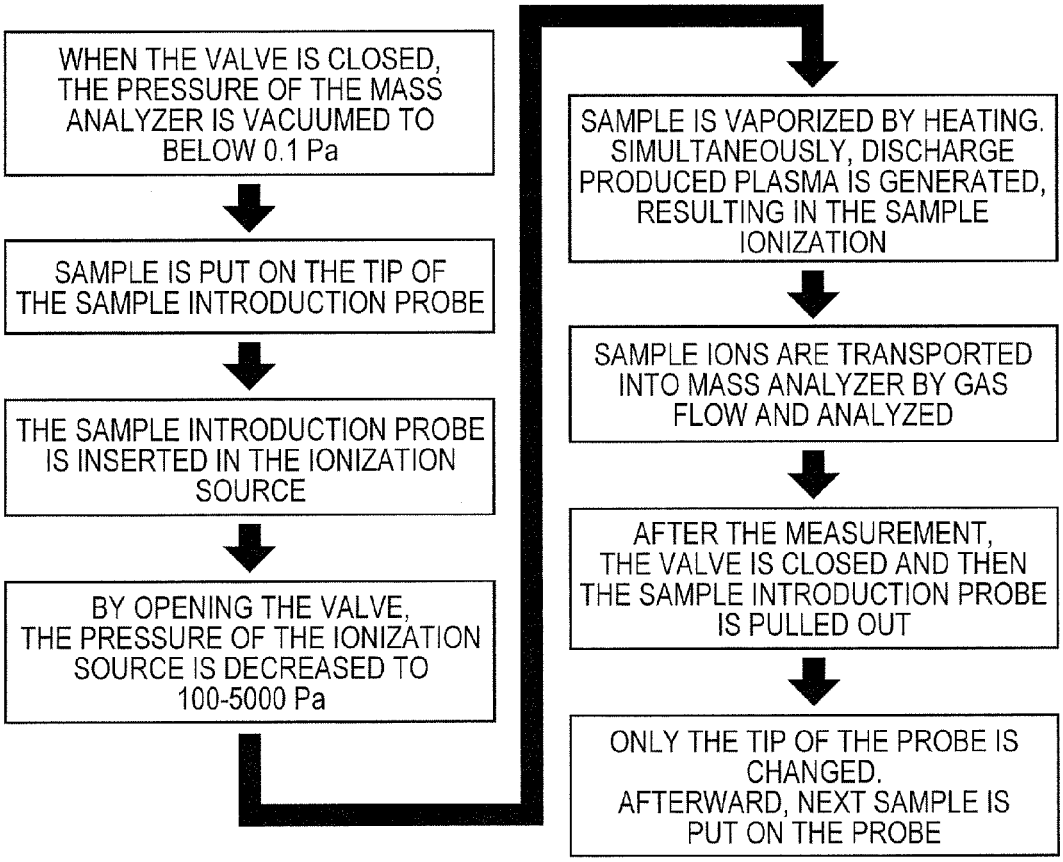
FIG. 6 is a flowchart of measurement.

FIG. 6 shows a typical measuring flow. First, the pump 2 is started in a state of closing the valve 4 and reduces a pressure in the vacuumed chamber 3 down to about 0.1 Pa or lower. The pressure in the vacuumed chamber is measured by a pressure gauge connected to the vacuumed chamber. A pressure in the ionization source is estimated on the basis of the measured pressure, an exhaust rate of the pump, and a conductance of the transfer line. For preparing the sample, the sample 7 is adhered to the tip end of the sample introduction probe 6. For example, a liquid or solid sample is directly coated on the tip end of the sample introduction probe 6. Or, an adsorbent adsorbing the sample is adhered to the tip end of the probe. The sample introduction probe 6 is inserted to the ionization source 1 in a state of adhering the sample 7. The valve 4 is opened, and the pressure in the ionization source 1 is reduced down to the pressure of stably generating the plasma. A typical example of the pressure falls in a range of 500 through 3000 Pa. When the pressure falls in a range of 100 through 500 Pa, fragmentation of ions is increased. When the pressure is equal to or higher than 3000 Pa, the plasma is difficult to be generated, and power supply needs to increase for generating the plasma. Next, the sample 7 is evaporated by heating. The sample 7 is evaporated by heating the sample 7 by making a current flow to the sample introduction probe 6.

Simultaneously therewith, the discharge produced plasma 10 is generated and the sample gas is ionized. Generated ions are efficiently introduced into the vacuumed chamber 3 by a gas flowing in from the gas introducing slender pipe 14, and are isolated for respective m/z. After the measurement has been finished, the valve 4 is closed and the sample introduction probe 6 is detached from the ionization source 1. The resistance heating filament 100 is interchanged to a new one in order to prevent carry-over to measurement of a successive sample. Thereby, a successive one of the sample 7 is installed at the resistance heating filament 100 and new measurement is started. The sample introduction probe 6 attached with the next sample 7 may be prepared.

In US 2010/0243884 A1, it is necessary to take out a total of the sample introduction probe from the sample vaporizing chamber in order to interchange the samples. A preparatory exhausting chamber having two valves is needed between the sample vaporizing chamber and the atmosphere in order to maintain pressures of the mass analyzer, the ionization source, and the sample vaporizing chamber. Therefore, a structure thereof is complicated and large-sized. On the other hand, according to the structure of the present invention, the valve 4 is present between the ionization source 1 and the vacuumed chamber 3. The pressure in the ionization source 1 is increased by closing the valve 4, and the sample introduction probe 6 can simply be taken out. Therefore, the structure of the present invention is simpler than that of US 2010/0243884 A1 and is suitable also for downsizing. In a case where not only the preparatory exhausting chamber but the valve 4 is not present, the pressure in the vacuumed chamber needs to increase for interchanging the sample. It is necessary await for reducing the pressure in the vacuumed chamber after inserting the sample probe to the ionization source in order to measure the successive sample, and the throughput is deteriorated. Therefore, the valve 4 is a configuration which is significant in carrying out the measurement with high throughput.

Figure 7A:
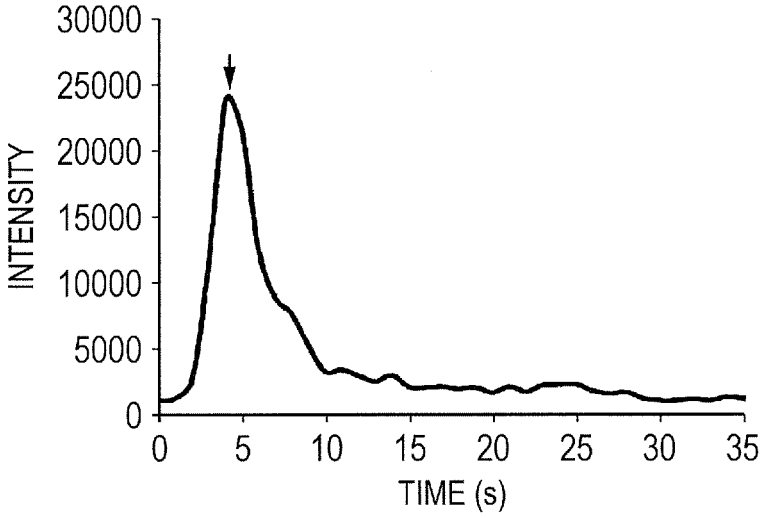
FIGS. 7A and 7B show an ion chromatograph and a mass spectrum.
Figure 7B:
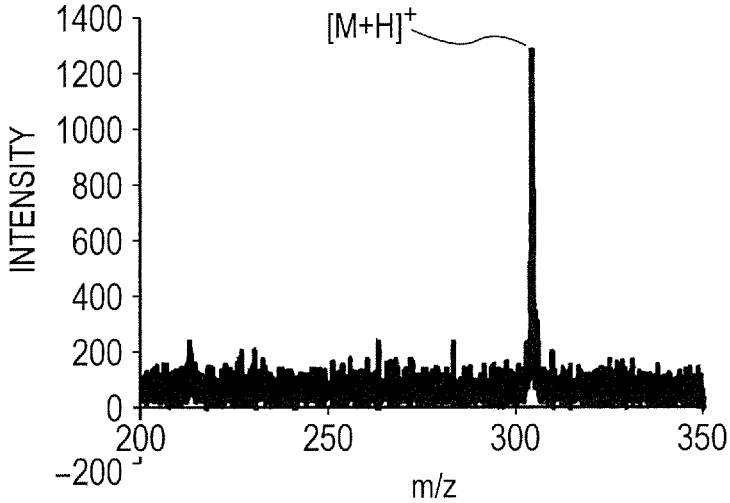

FIGS. 7A and 7B show a measurement result when the filament is heated for about 3 seconds with cocaine as a sample by the configuration shown in FIG. 1. FIG. 7A shows an ion chromatograph after the heating is started, and FIG. 7B shows a mass spectrum at a time point of an arrow mark of FIG. 7A. Cocaine is evaporated immediately after heating the sample, and there can be measured $[M+H]^+$ (m/z 304.3) of cocaine which is ionized by proton transfer.

As shown by the result, a time period taken from evaporation to ionization of one sample is several seconds, and it is known that the measurement can be performed with high throughput.

Second Embodiment

Figure 8:
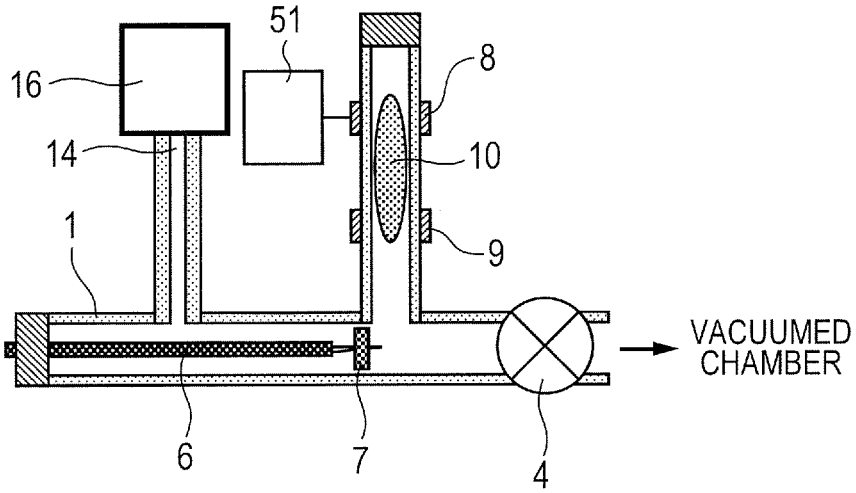
FIG. 8 illustrates an ionization source of a second embodiment.

FIG. 8 is a configuration view showing an embodiment of the mass spectrometer according to the present invention. The vacuumed chamber 3 is similar to that of the first embodiment and an illustration thereof will be omitted. The pressure condition of the discharge produced plasma 10 and the output voltage of the power source 51 are also similar to those of the first embodiment. Different from the first embodiment, according to the second embodiment, the sample 7 adhered to the tip end of the sample introduction probe 6 is vaporized by introducing a gas from a high temperature gas generating source 16 to the ionization source 1 through the gas introducing slender pipe 14. Therefore, the resistance heating filament 100 is not needed at the tip end of the sample introduction probe 6, and it is not necessary to connect a power source to the sample introduction probe 6. It is necessary to directly coat the sample 7 at the tip end of the sample introduction probe 6, or fix an adsorbent adsorbing the sample 7 to a jig attached to the tip end of the sample introduction probe 6. Different from the first embodiment of locally heating only the sample 7, a high temperature gas passes through the ionization source 1. Therefore, the adsorption of the sample to the transfer line is reduced. A measurement flow is similar to that of the FIG. 6 except the way of heating the sample. In a case of using the high temperature gas, in comparison with the case of using the resistance heating filament 100, the power which is needed for heating the sample 7 up to the same temperature is considerable. In comparison with the resistance heating filament 100, the sample 7 cannot rapidly be heated by the high temperature gas.

Third Embodiment

Figure 9:
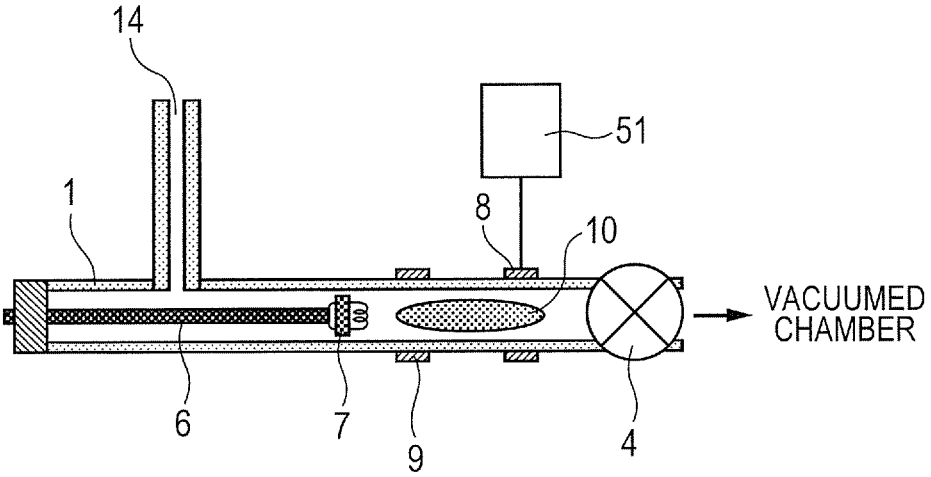
FIG. 9 illustrates an ionization source of a third embodiment.
Figure 10:
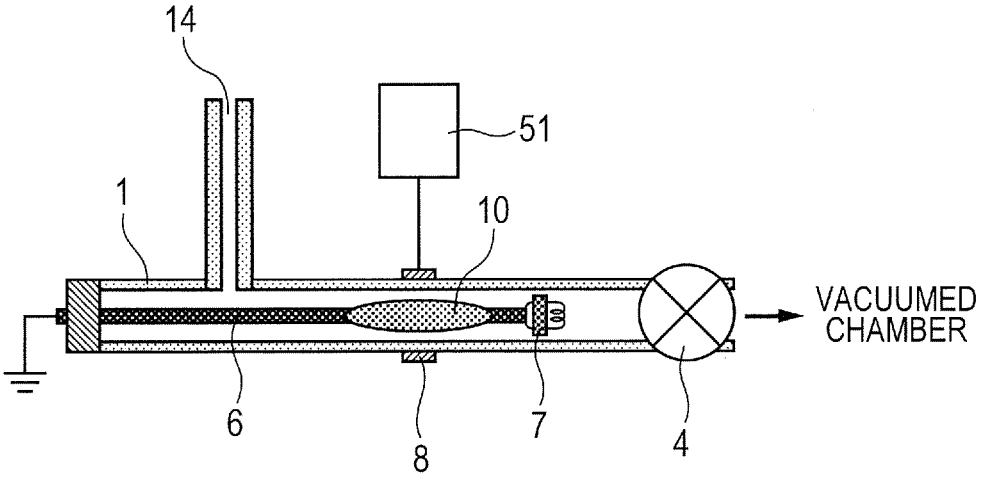
FIG. 10 illustrates other example of the ionization source of the third embodiment.

FIG. 9 is a configuration view showing an embodiment of the mass spectrometer according to the present invention. The vacuumed chamber 3 is similar to that of the first embodiment and the illustration will be omitted. The pressure condition of the plasma 10 and the outputted voltage of the power source 51 are also similar to those of the first embodiment. Different from the first and the second embodiments, a portion in the ionization source 1 for generating the discharge produced plasma 10 is arranged coaxially with the sample introduction probe 6. So far as the portion is coaxial with the sample introduction probe 6, the discharge produced plasma 10 may be generated between the sample 7 and the valve 4 or on a side of the gas introducing slender pipe 14 relative to the sample 7. The sample 7 may be exposed directly to the discharge produced plasma 10. Or, as shown in FIG. 10, the sample introduction probe 6 is made to be one of the discharge electrodes, and the discharge produced plasma 10 may be generated between the sample introduction probe 6 and another one of the discharge electrodes via a dielectric substance. According to the embodiment, as a system of heating the sample 7, either of the method of heating the sample 7 by making a current flow to the sample introduction probe 6 by using the resistance heating filament 100 at the tip end of the sample introduction probe 6 or the method of introducing the high temperature gas from the gas introducing slender pipe 14 will do. However, in a case where the sample introduction probe 6 is made to be one of the discharge electrodes and the resistance heating filament 100 is used, there are needed wirings to the filament portion in a state of being insulated from the discharge electrode of the sample introduction probe 6.

When the sample gas passes through the plasma area, the sample gas is ionized more efficiently than in a case where the sample gas does not pass through the plasma area. On the other hand, the sample gas is easy to be subjected to fragmentation. The fragmentation is alleviated when a flow rate of the gas passing through the plasma area is increased. The structure of the ionization source 1 becomes simple and easy to be downsized by making the plasma area coaxial with the sample introduction probe 6. The measurement flow is similar to that of FIG. 6.

Fourth Embodiment

Figure 11:
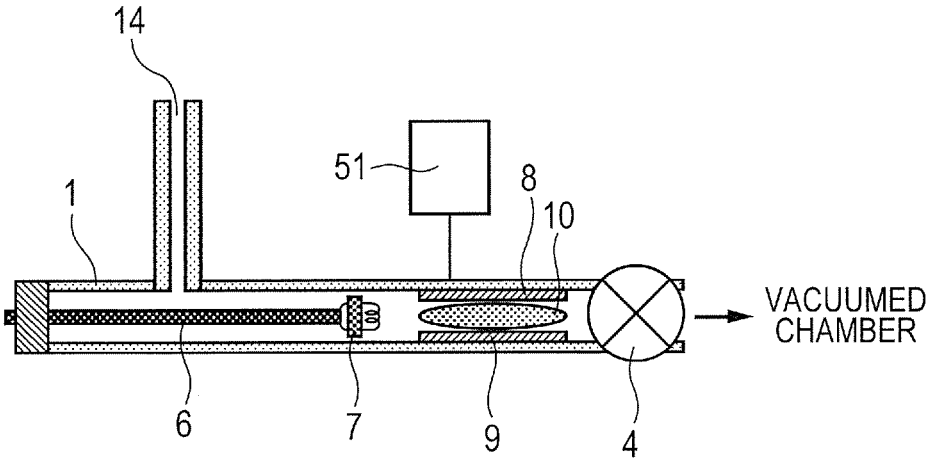
FIG. 11 illustrates an ionization source of a fourth embodiment.

FIG. 11 is a configuration view showing an embodiment of the mass spectrometer according to the present invention. The vacuumed chamber 3 is similar to that of the first embodiment and the illustration will be omitted. Also the pressure condition of the discharge produced plasma 10 is similar to that of the first embodiment. Different from the first through the third embodiments, two of discharge electrodes are arranged in the ionization source 1 and a DC voltage is applied between the electrodes. Thereby, glow discharge is generated without interposing a dielectric substance between the electrodes. Thereby, the discharge produced plasma 10 is generated. A current is limited by putting a current limiting resistor between the electrode and the power source 51 to thereby make discharge soft. The discharged produced plasma 10 may be generated between the sample 7 and the valve 4, or may be generated on a side of the gas introducing slender pipe 14 relative to the sample 7. The sample 7 may directly be exposed to the discharge produced plasma 10. The discharge produced plasma 10 may be generated at a position which is not coaxial the sample introduction probe as in the first embodiment. The sample introduction probe 6 may be used as the discharge electrode as in the third embodiment. As a system of heating the sample 7, either of the method of heating the sample by making a current flow to the probe by using the resistance heating filament 100 at the tip end of the sample introduction probe 6 or the method of introducing the high temperature gas from the gas introducing slender pipe 14 will do. In a case of discharge interposing a dielectric substance, it is necessary to apply an alternating current voltage. However, in a case of glow discharge without interposing the dielectric substance, the DC voltage may be applied and design of the power source is simple. On the other hand, there is a possibility of contamination since the electrode is present at inside of the ionization source, and robustness is higher in the first embodiment.

Fifth Embodiment

Figure 12:
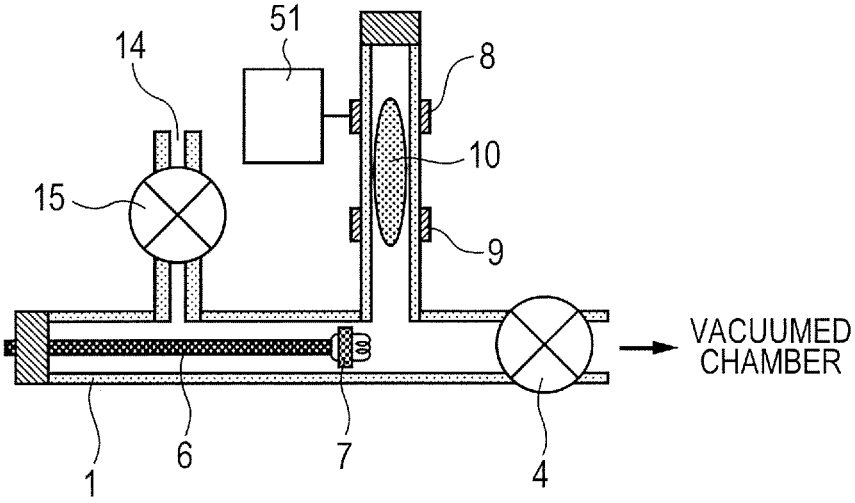
FIG. 12 illustrates an ionization source of a fifth embodiment.

FIG. 12 is a configuration view showing an embodiment of the mass spectrometer according to the present invention. The vacuumed chamber 3 is similar to that of the first embodiment and the illustration will be omitted. Also the pressure condition of the discharge produced plasma 10 is similar to that of the first embodiment. According to the present embodiment, a pulse valve 15 is installed at the gas introducing slender pipe 14, and a gas is intermittently introduced to the ionization source 1. When the gas is introduced, the pressure in the ionization source 1 is temporarily increased, and when the pulse valve 15 is closed, the pressure in the ionization source 1 is reduced. Therefore, in comparison with the continuous gas introducing system of the first through the fourth embodiments, even when a flow rate is increased by enlarging an inner diameter of the gas introducing slender pipe 14, after closing the pulse valve 15, the pressure in the vacuumed chamber 3 can be maintained at 0.1 Pa or lower. When the flow rate is increased, and a flow speed of a gas passing through the ionization source 1 is increased, residence time of the sample gas at the ionization source 1 is shortened and the adsorption to the transfer line is reduced. Conversely, when gas introducing amounts of the continuous gas introducing system and the vacuumed chamber are the same, a smaller-sized pump having a low exhaust rate can be used. The pressure in the ionization source and the pressure in the chamber can be controlled by a conductance of the transfer line and valve opening time. The pressure in the vacuumed chamber can be increased up to a pressure of efficiently generating collision-induced dissociation by opening the pulse valve 15 again in a state of trapping ions at the mass analyzer 11. That is, the pressure in the vacuumed chamber can conveniently and simply be adjusted by the presence of the pulse valve. The heating resistance filament 100 may be used, or the high temperature gas may be introduced from the gas introducing pipe 14 via the pulse valve 15 for evaporating the sample. The discharge produced plasma 10 may be generated by the electrodes arranged via the dielectric substance as in the first through the third embodiments, or may be generated by glow discharge without interposing the dielectric substance as in the fourth embodiment. The pressure in the vacuumed chamber is increased by opening or closing the pulse valve even temporarily, and therefore, a burden is applied on the pump 2 and the frequency of interchanging the pump 2 is increased in comparison with that in the first embodiment. A circuit and a power source for controlling the pulse valve 15 are needed and the configuration is more complicated than in the first embodiment.

Sixth Embodiment

Figure 13:
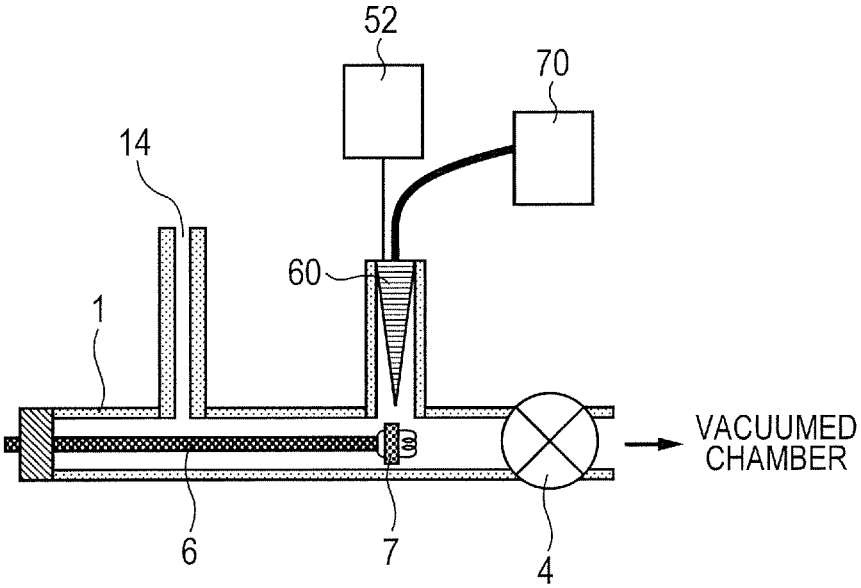
FIG. 13 illustrates an ionization source of a sixth embodiment.

FIG. 13 is a configuration view showing an embodiment of the mass spectrometer according to the present invention. The vacuumed chamber 3 is similar to that of the first embodiment and the illustration will be omitted. A probe 60 for electrospray ionization is inserted to the ionization source 1. A potential difference of 1-10 kV is produced between the probe 60 for electrospray ionization connected with a high voltage power source 52 and the sample introduction probe 6 or between the probe 60 and other electrode provided in the ionization source 1.

Charged droplets are generated by injecting a solution from the probe 60 for electrospray ionization connected with a pump 70 for feeding the solution. Ions generated from the charged droplets are impacted to the sample 7 installed at the tip end of the sample introduction probe 6, and sample ions are generated. The sample ions are introduced to the vacuumed chamber 3 by a gas flow. Or, the sample is vaporized by the resistance heating filament 100 or the high temperature gas, and the charged droplets are injected to the vaporized sample. The vaporized sample is taken into the charged liquid drops, and ionized by the principle of electrospray. The sample ions are introduced to the vacuumed chamber 3 by the gas flow. The loss in introducing ions from the ionization source to the vacuumed chamber is reduced and the sensitivity is increased by ionizing the sample under a reduced pressure similar to the other embodiments. On the other hand, when the pressure is excessively low, thermal energy cannot be given from the surrounding gas to the charged droplets, and the charged droplets cannot be broken and evaporated to thereby reduce an ionization efficiency. Therefore, the pressure in the ionization source is made to be able to maintain both of the ionization efficiency and the efficiency of introducing ions to the vacuum chamber 3 at high levels. Specifically, the pressure preferably falls in a range of 100 through 5000 Pa.

Although in the discharge produced plasma, a sample is gasified and thereafter ionized, a high mass molecule is difficult to be volatilized and therefore, the molecule is difficult to be ionized. On the other hand, according to the electrospray ionization method shown in the present embodiment, the sample can be ionized directly from a solution state. Therefore, even the high mass molecule can easily be ionized. Therefore, the method is effective when the object of the measurement is protein, peptide, or polysaccharide. On the other hand, there is needed the pump 70 for feeding the solution for generating the charged droplets to the probe 60 for electrospray ionization, and a structure thereof becomes complicated. In order to stably generate the charged droplets, an inert gas of nitrogen or the like may be introduced as an auxiliary gas in a shape of a concentric circle of an injection port of the probe 60 for electrospray ionization. Although in FIG. 13, the probe 60 for electrospray ionization is disposed vertically to the sample introduction probe 6, the positional relationship may be adjusted such that the sensitivity is maximized. The present invention is not restricted by the method of vaporizing the sample 7 inserted to the ionization source 1 as shown in examples.

Seventh Embodiment

Figure 14:
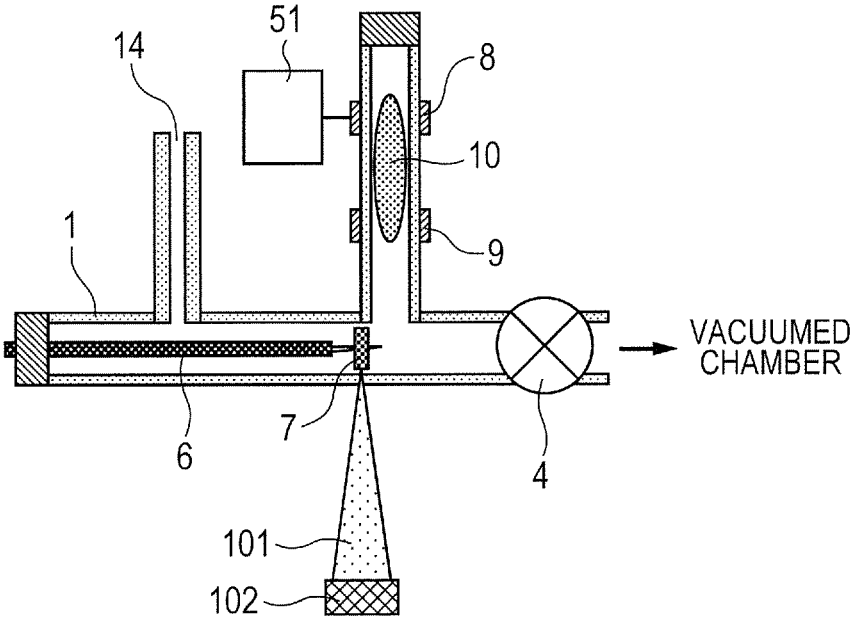
FIG. 14 illustrates an ionization source of a seventh embodiment.

FIG. 14 is a configuration view showing an embodiment of the mass spectrometer according to the present invention. The vacuumed chamber 3 is similar to that of the first embodiment and the illustration will be omitted. In the embodiments described above, the sample 7 is vaporized by using the heating filament attached to the tip end of the sample introduction probe 6 or by using the high temperature gas. On the other hand, according to the present embodiment, the sample 7 is vaporized by irradiating the sample 7 with a laser 101 from outside of the ionization source 1. The vaporized sample is ionized by the plasma generated by the dielectric barrier discharge or the glow discharge described above. Or, the sample 7 may be ionized by the charged droplets blown from the probe for electrospray ionization. According to the present embodiment, there is no restriction in the ionizing method. In comparison with the case of vaporizing the sample 7 by the heating filament or the high temperature gas, the sample 7 can be vaporized further softly by the laser 101 by adjusting a wavelength of the laser 101, and the method is suitable for a molecule which is easy to be destructed. Conversely, when a laser having a wavelength which is near to an absorption wavelength of the sample is used, the sample can directly be ionized, and the ionization efficiency is increased. On the other hand, a light source 102 and an optical system for laser are needed, and a configuration of a total of the mass spectrometer becomes complicated. An irradiation position of the laser 101 needs to be adjusted accurately.

Eighth Embodiment

Figure 15:
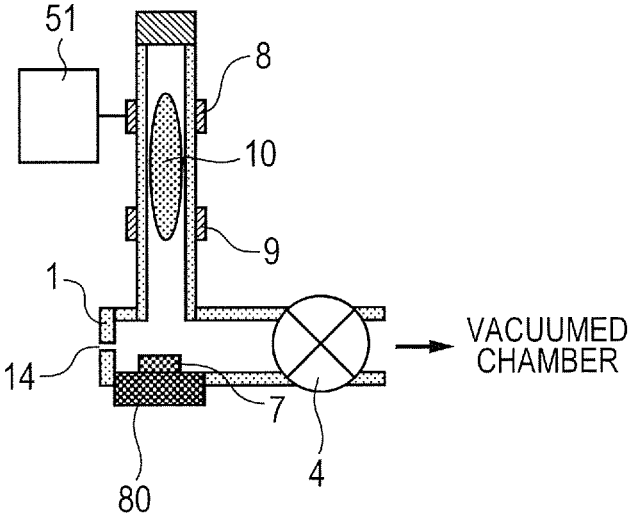
FIG. 15 illustrates an ionization source of an eighth embodiment.

FIG. 15 is a configuration view showing an embodiment of the mass spectrometer according to the present invention. The vacuumed chamber 3 is similar to that of the first embodiment and the illustration will be omitted. According to the embodiments described above, the sample 7 is introduced to the ionization source 1 by using the sample introduction probe 7 in a shape of a rod. On the other hand, according to the present embodiment, the sample 7 is adhered to an upper portion of a sample plate 80 which is attachable and detachable to and from the ionization source 1 and the sample 7 is introduced to the ionization source 1. A position of the sample plate 80 may be at any place in the ionization source so far as the position is at a place at which the pressure is equal to the pressure at the plasma area. In heating the sample 7, there is conceivable a method of heating the sample plate 80 by attaching a heater to outside of the sample plate 80, a method of integrating a heating filament to the sample plate 80, a method of introducing the high temperature gas from the gas introducing slender pipe 14, or a method of heating the sample by laser irradiation. The vaporized sample is ionized by a glow discharge method, an electrospray ionization method other than the dielectric barrier discharge method described in the drawing, and is introduced to the vacuumed chamber 3. The present embodiment has a performance substantially equivalent to that of the first embodiment.

Ninth Embodiment

Figure 16:
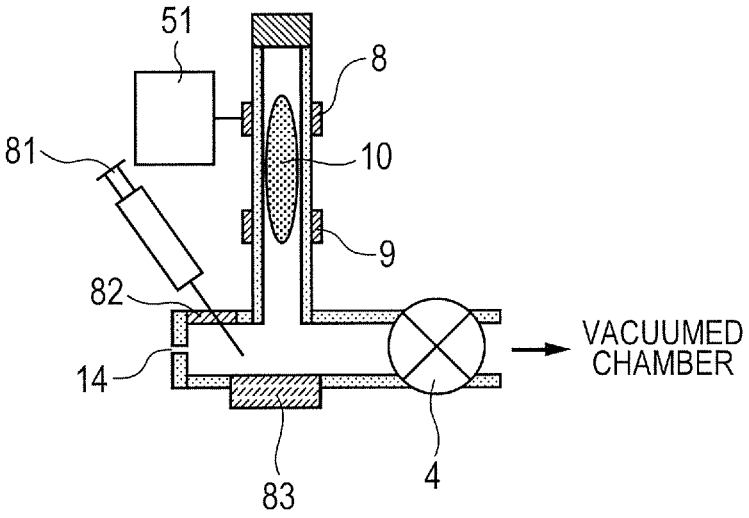
FIG. 16 illustrates an ionization source of a ninth embodiment.

FIG. 16 is a configuration view showing an embodiment of the mass spectrometer according to the present invention. The vacuumed chamber 3 is similar to that of the first embodiment and the illustration will be omitted. The ionization source 1 according to the present embodiment is set with a heating plate 83 and a rubber plate 82 by which the air tightness of the ionization source is not broken even when a needle is pierced to the rubber plate 82. The sample is dropped to the heating plate through the rubber plate 82 by using a syringe 81 attached with a needle. The sample is immediately vaporized on the heating plate. The vaporized sample is ionized by a method of glow discharge, electrospray ionization or the like other than the dielectric discharge illustrated in the drawing, and is introduced to the vacuumed chamber 3. After measurement at one time, when there is not carry-over of the sample, measurement of a successive sample can be carried out continuously without changing the heating plate, and therefore, the throughput is high. In a case where carry-over is brought about, the valve 4 is closed, and the heating plate is interchanged while maintaining a vacuum degree of the vacuumed chamber 3, According to the present embodiment, the heating portion is brought into contact with the ionization source 1. Unless design is carried out in consideration of heat transfer, there is a possibility that a temperature of a portion touched by a user becomes high, which is dangerous.

What is claimed is:

1. A mass spectrometer comprising:

a sample attaching member configured to attach to a sample;

an ionizing chamber, including: an introductory port to the sample attaching member, a heating element to vaporize a portion of the sample, and a pair of electrodes, one of which is located outside of the ionization chamber, provided by interposing a portion of the ionization chamber configured by a dielectric substance, wherein the vaporized portion of the sample is ionized within the ionizing chamber by ion-molecule reactions in a plasma generated by dielectric barrier discharge;

a vacuumed chamber, including a mass analyzer configured to analyze the ionized portion of the sample; and an opening/closing mechanism provided between the ionizing chamber and the vacuumed chamber;

wherein the opening/closing mechanism is controlled to transition from a closed state to an open state after introducing the sample attaching member into the ionizing chamber;

wherein the pair of electrodes generating plasma and the plasma area in the ionizing chamber is disposed at a position closer to the vacuumed chamber than the position at which the sample are disposed in relation to the vacuumed chamber; and wherein the vaporized portion of the sample is ionized when passed through the plasma area to introduce the ionized portion of the sample into the vacuumed chamber.

2. The mass spectrometer according to claim 1, wherein the ionized portion of the sample is generated by reducing a pressure of the ionizing chamber to be equal to or higher than 100 Pa and equal to or lower than 5000 Pa from a side of the vacuumed chamber by bringing the opening/closing mechanism into the open state.

3. The mass spectrometer according to claim 1, wherein a pressure of the vacuumed chamber in reducing the pressure of the ionizing chamber is equal to or lower than 0.1 Pa.

4. The mass spectrometer according to claim 1, wherein the ionizing chamber includes an orifice of introducing a gas from an outer portion to an inner portion of the ionization source.

5. The mass spectrometer according to claim 4, wherein the orifice includes an orifice opening/closing mechanism of controlling to introduce the gas.

6. The mass spectrometer according to claim 4, wherein the gas is a heating gas which vaporizes the sample arranged at the sample attaching member.

7. The mass spectrometer according to claim 1, wherein the ionizing chamber has a conductance by which a pressure in the ionizing chamber substantially stays the same all over the ionizing chamber.

8. The mass spectrometer according to claim 1, wherein any pressure differential within the ionizing chamber is less than or equal to double the average pressure in the ionizing chamber.

9. The mass spectrometer according to claim 1, wherein the sample attaching member is a rod-like sample introduction probe.

10. The mass spectrometer according to claim 9, wherein a tip end of the sample introduction probe includes a filament and an adsorbent provided to the filament and an outer portion of the ionizing chamber includes a heating power source of heating the filament.

11. The mass spectrometer according to claim 1, further comprising:

a light source of evaporating the sample arranged at the sample attaching member by irradiating the sample with light.

12. The mass spectrometer according to claim 1, wherein, the ionization source, the opening/closing mechanism provided between the ionization source and the vacuumed chamber, and the vacuumed chamber are coaxially arranged to allow the ionized sample to pass through the opening/closing mechanism into the vacuumed chamber.

13. The mass spectrometer according to claim 1, wherein the ionization source is connected with the vacuumed chamber, without an intervening differential pumping region.

14. The mass spectrometer according to claim 1, further comprising:

a gas introducing slender pipe connected to the ionization source on a side opposed to the vacuumed chamber relative to the sample;

wherein a gas flow is produced from the gas introducing slender pipe to the vacuumed chamber, due to a difference between a pressure inside of the ionization source and the vacuumed chamber, and a pressure outside of the ionization source; and wherein the gas flow transports sample ions into the vacuumed chamber.

15. The mass spectrometer according to claim 1, wherein the sample vaporizing area and the ionizing area each is disposed along a pipe, and the inner diameter of the pipe proximate the sample vaporizing area being equal to the inner diameter of the pipe proximate the ionizing area is the same.

16. The mass spectrometer according to claim 1, wherein the opening/closing mechanism is located between the ionizing chamber and an orifice which is an entrance of a housing containing mass analyzer without an intervening differential pumping region.

17. A mass analyzing method, using an ionizing chamber configured by a dielectric substance, the ionizing chamber including an introductory port to a sample attaching member configured to attach a sample and a pair of electrodes, one of which is located outside of the ionization chamber, provided by interposing a portion of the ionization chamber, generating plasma, a vacuumed chamber including a mass analyzer, and an opening/closing mechanism provided between the ionizing chamber and the vacuumed chamber, the mass analyzing method comprising:

reducing a pressure of the vacuumed chamber to be equal to or lower than 0.1 Pa in a state of closing the opening/closing mechanism;

introducing the sample attaching member arranged with the sample to the ionization source;

making a pressure of the ionizing chamber equal to or higher than 100 Pa and equal to or lower than 5000 Pa by bringing the opening/closing mechanism to an open state after introducing the sample attaching member;

vaporizing a portion of the sample;

generating an ionized portion of the sample arranged at the sample attaching member within the ionizing chamber by ion-molecule reactions in a plasma area, wherein a pair of electrodes and the plasma area are disposed in the ionizing chamber closer to the vacuumed chamber than the position at which the sample is disposed in relation to the vacuumed chamber and the vaporized portion of the sample is ionized when passed through the plasma area to introduce the ionized portion of the sample into the vacuumed chamber; and analyzing a mass, by use of the mass analyzer, of the ionized portion of the sample introduced from the ionizing chamber to the vacuumed chamber.

18. The mass analyzing method according to claim 17, further comprising:

producing a gas flow via a gas introducing slender pipe connected to the ionization source on a side opposed to the vacuumed chamber relative to the sample, wherein the gas flows to the vacuumed chamber due to a difference between a pressure inside of the ionization source and the vacuumed chamber, and a pressure outside of the ionization source; and transporting sample ions into the vacuumed chamber via the gas flow.

19. A mass spectrometer comprising:

a sample attaching member configured to attach to a sample;

an ionizing chamber, including an introductory port to the sample attaching member, a heating element to vaporize a portion of the sample, and a pair of electrodes, one of which is located outside of the ionization chamber, provided by interposing a portion of the ionization chamber configured by a dielectric substance, wherein the vaporized portion of the sample is ionized within the ionizing chamber by ion-molecule reactions in a plasma generated by dielectric barrier discharge;

a vacuumed chamber, including a mass analyzer configured to analyze the ionized portion of the sample;

an opening/closing mechanism provided between the ionizing chamber and the vacuumed chamber; and a gas introducing slender pipe connected to the ionizing chamber on a side opposed to the vacuumed chamber relative to the sample;

wherein the opening/closing mechanism is controlled to transition from a closed state to an open state after introducing the sample attaching member into the ionizing chamber;

wherein the pair of electrodes generating plasma and the plasma area in the ionizing chamber are disposed at a position closer to the vacuumed chamber than the position at which the sample is disposed in relation to the vacuumed chamber;

wherein the vaporized portion of the sample is ionized when passed through the plasma area;

wherein a gas flow is produced from the gas introducing slender pipe to the vacuumed chamber, due to a difference between a pressure inside of the ionization source and the vacuumed chamber, and a pressure outside of the ionization source; and wherein the gas flow transports sample ions to introduce the ionized portion of the sample into the vacuumed chamber.

* * * * *